United States Patent [19]

Klosterman

[11] Patent Number: 4,845,857

[45] Date of Patent: Jul. 11, 1989

[54] TIE LENGTH MEASURING DEVICE

[76] Inventor: Larry Klosterman, 36718 Thomas, Sterling Heights, Mich. 48077

[21] Appl. No.: 146,593

[22] Filed: Jan. 21, 1988

[51] Int. Cl.[4] ..... B43L 7/00

[52] U.S. Cl. ..... 33/613; 33/485

[58] Field of Search ..... 33/485, 483, 492, 494, 33/2 H, 613; 2/146; 224/202

[56] References Cited

U.S. PATENT DOCUMENTS

| | | | |
|---|---|---|---|
| D. 136,673 | 11/1943 | Reiter | D10/71 |
| D. 210,411 | 3/1968 | Joyce | D10/71 |
| D. 222,291 | 10/1971 | Seiersen | D10/71 |
| D. 288,538 | 3/1987 | Cabaniss | D10/62 |
| 1,607,097 | 11/1926 | Murphy | 33/485 |
| 2,373,338 | 4/1945 | Rakauskas | 33/173 |
| 2,592,362 | 4/1952 | Weeks | 33/483 X |
| 2,734,270 | 2/1956 | Finnegan | D10/71 |
| 3,305,933 | 2/1967 | Munday, Jr. . | |

*Primary Examiner*—Harry N. Haroian

*Attorney, Agent, or Firm*—Basile and Hanlon

[57] ABSTRACT

A tie length measuring device including an elongated member with an attaching means for attaching said member to the user's clothing, and a measuring means for determining the correct position at which to tie the user's necktie. The elongated member may have various measuring means such as lines or, alternatively, sections which may be broken off to reduce the length of the member to a desired length. Additionally, the attaching means may consist of more than one type of clip means for attaching the device to the user's clothing.

13 Claims, 1 Drawing Sheet

TIE LENGTH MEASURING DEVICE

BACKGROUND OF THE INVENTION

1. Field of the Invention

The present invention is concerned with a device removably attachable to the waistline of a user's trousers for assisting the user in tying neckties to the proper length.

2. Description of the Prior Art

Prior art relevant to the above field of invention has been limited to rack devices upon which the tie is hung, prior to wearing, and which places a mark upon the tie to designate the place at which the knot should be tied. The rack device is relatively complex in design and necessitates attachment to a vertical surface such as a wall or door. The prior art not only necessitates placing a mark upon the tie, but also takes much more time to use than the simple device of the present invention.

The present invention is directed to a tie length measuring device which is simple to use and which may be utilized by any tie wearer without modification.

SUMMARY OF THE INVENTION

In accordance with the present invention, a tie length measuring device for use with a necktie comprises an elongated member made of a flat, thin material such as metal, cardboard, plastic sheeting, paper, or other similar materials. Affixed to a first end of the elongated member is an attaching means which is used to releasably attach the member to a user's waistband or other article of clothing. The attaching means may consist of a hook which is fixedly attached to the waistband or, alternately, an integral hook portion which is formed by folding or bending the first end of the member into the form of a hook.

The elongated member has a middle portion extending vertically downward from a first end when the device is attached to the user's waist. The middle portion is an ideal location for advertising or the like to be placed on the device.

A second end of the elongated member has measuring means attached thereto for determining the proper positioning of the necktie prior to tying. The measuring means may consist of markings, or sections which may be cut away to bring the elongated member to a predetermined length. In use, the device is attached to the user, such as at his waist. The user puts the tie around his neck and aligns the wide end of the tie with a predetermined mark or position on the device. Use of the device in this manner allows the user to tie a tie to the correct length every time.

Other objects and features of the invention will become apparent by reference to the following specification and to the drawings.

BRIEF DESCRIPTION OF THE PREFERRED EMBODIMENT

Figure 1:
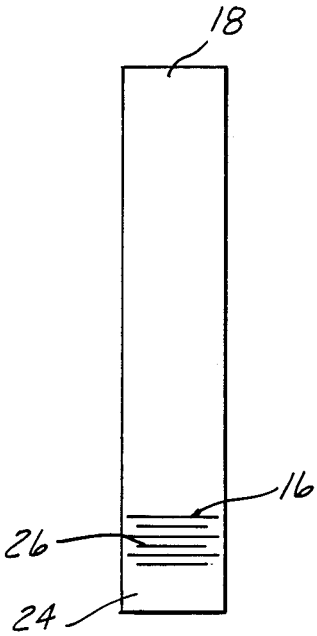
FIG. 1 is a front elevational view of the first embodiment of the tie length measuring device of the present invention.

In FIG. 1 there is shown a typical embodiment of the tie length measuring device of the present invention. The tie length measuring device designated generally as 10 comprises an elongated member 12, an attaching means 14 fixed to a first end of said member 12, and a measuring means 16 fixed to a second end of said member 12.

The elongated member 12 is made of a flat, thin, and preferably flexible strip of material. The material may comprise metal, cardboard, plastic sheeting, paper, or other similar material.

Figure 2:
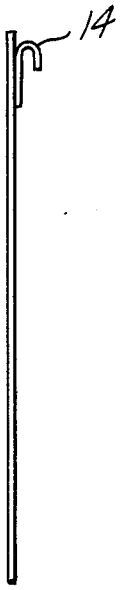
FIG. 2 is a side view of the present invention showing the attaching means attached thereto.
Figure 3:
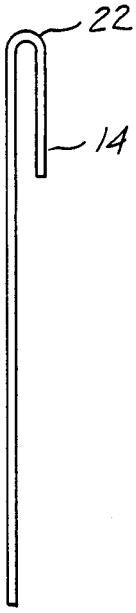
FIG. 3 is a side view of the present invention showing a second embodiment of the attaching means.
Figure 4:
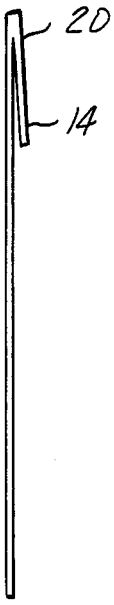
FIG. 4 is a side view of the present invention showing a third embodiment detaching means.
Figure 5:
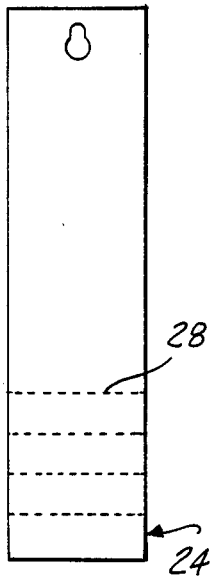
FIG. 5 is a front elevational view showing a second embodiment of the present invention.

Connected to a first end portion 18 of the elongated member 12, for releasably attaching the member 12 to a waistband or other article of a user's clothing is an attaching means 14. The attaching means, as shown in FIG. 2, may consist of a hook made of flexible metal, plastic, or other similar material. As shown in FIGS. 3 and 4, the attaching means may consist of an integral hook portion, integral with the elongated member, which is formed by folding, as at 20, or bending, as at 22, the first end 18 of the elongated member so as to form a hook. Additionally, as shown in FIG. 5, the attaching means may consist of an aperture 25 formed in the first end portion 18 of the elongated member 12 for releasably attaching member 12 to a lower button on the user's shirt. The attaching means, as noted above, is preferably of a flexible material so that attachment to the waistband of the user's clothing is facilitated.

Fixed to a second end portion 24 of the elongated member 12 is the measuring means 16. The measuring means 16 preferably consists of hash marks or lines 26 placed upon the second end portion 24 on the surface of the member 12 which faces outward, away from the user's body.

Alternatively, the measuring means may consist of sections 28 which may be cut or broken away, as by perforations, to reduce the overall length of the device 10 to a predetermined desired length.

Figure 6:
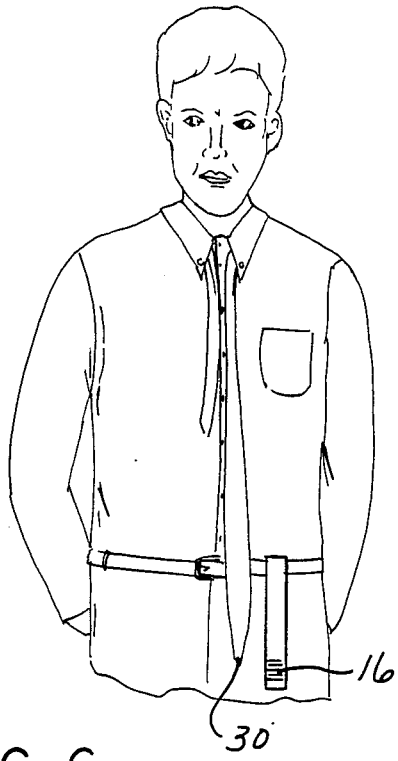
FIG. 6 is a view of the present invention in use.

In use, as shown in FIG. 6, the device is attached to the user, such as at his waist, or a lower shirt button. The user then determines the proper positioning of a necktie for tying by simply placing the necktie about the neck and aligning the end of the tie 30 with a predetermined position on the measuring means 16 of the device. Use of the device in this manner allows the user to tie the tie to a correct length every time. Once the tie is tied to the proper length, the device is simply unhooked from the user's clothing.

While one embodiment of the invention has been described in detail above, in relation to tie length measuring devices, it would be apparent to those skilled in the art that the disclosed embodiment may be modified. Therefore, the foregoing description is to be considered exemplary rather than limiting and the true scope of the invention is that defined in the following claims.

What is claimed is:

1. A tie length measuring device used in conjunction with an untied necktie and associated clothing of a wearer comprising:

an elongated member having first and second ends, said member releasably attached to the wearer's clothing in close proximity to the front portion of the wearer's waist and extending perpendicularly downward therefrom;

means for releasably attaching said member to the wearer's clothing in close proximity to the wearer's waist, said attaching means immovably connected to said first end of the elongated member;

means for measuring the length of the untied necktie carried by said elongated member, said measuring means located proximate to said second end of the said elongated member and in proportional relationship to the finished length of the tied necktie.

2. The device of claim 1, wherein the elongated member is a flat, thin, flexible strip of metal.

3. The device of claim 1, wherein the attaching means is a hook located proximate to the first end and constructed of a flexible material.

4. The device of claim 3, wherein the hook is integrally formed with said elongated member at said first end.

5. The device of claim 1, wherein the elongated member has an aperture formed adjacent to said first end of said elongated member, said aperture having a size and configuration suitable to releasably receive a button on a wearer's shirt.

6. The device of claim 1, wherein the measuring means comprises markings placed proximate to said second end of said elongated member, on a surface of said member facing outwardly, away from the wearer's body.

7. The device of claim 1, wherein the elongated member comprises means for altering the length of said member, said means comprising detachable measured sections located at said second end.

8. The device of claim 1 wherein said elongated member is a flat, thin, flexible strip of cardboard.

9. The device of claim 1 wherein said elongated member is a flat, thin, flexible strip of plastic.

10. The device of claim 1 wherein said elongated member is a flat, thin, flexible strip of paper.

11. The device of claim 3 wherein said flexible material is metal.

12. The device of claim 3 wherein said flexible material is plastic.

13. A method for determining the appropriate length of a necktie prior to completion of the tying the necktie comprising the steps of:

draping the necktie around the neck having two ends around the neck of a wearer such that the two ends are oriented toward the front of the wearer;

releasably attaching a tie length measuring device to the garment of the wearer in proximity to the waist of the wearer, the tie length measuring device comprising:

(a) an elongated member having first and second ends, the elongated member being oriented perpendicularly to said wearer's waist;

(b) means for attaching said elongated member to the garment adjacent to the wearer's waist, said attachment means connected to said first end; and (c) means for measuring the necktie length, said measuring means carried on said elongated member proximate to said second end;

adjusting the length of one end of said necktie in correspondence with said measuring means;

tying the necktie; and removing the tie length measuring device.

* * * * *